US006055944A

United States Patent [19]

Santiago

[11] Patent Number: 6,055,944

[45] Date of Patent: May 2, 2000

[54] HEATING DEVICE

[75] Inventor: Roberto Santiago, Buenos Aires, Argentina

[73] Assignee: Eskabe S.A., Buenos Aires, Argentina

[21] Appl. No.: 09/340,934

[22] Filed: Jun. 28, 1999

Related U.S. Application Data

[63] Continuation-in-part of application No. 09/009,867, Jan. 22, 1998.

[30] Foreign Application Priority Data

Jan. 22, 1997 [AR] Argentina ..... P/97/01/06226
Jan. 2, 1998 [AR] Argentina ..... P/98/01/00011

[51] Int. Cl.[7] ..... F22B 5/00

[52] U.S. Cl. ..... 122/17; 122/447; 122/448.1; 126/350 R

[58] Field of Search ..... 122/13.1, 17, 448.1, 122/447, 13.2; 126/350 R, 351, 361

[56] References Cited

U.S. PATENT DOCUMENTS

| | | | |
|---|---|---|---|
| 1,502,295 | 7/1924 | Kermor | 122/13.2 |
| 4,354,094 | 10/1982 | Massey et al. | 122/13.1 |
| 5,224,445 | 7/1993 | Gilbert, Sr. | 122/448.1 |
| 5,233,970 | 8/1993 | Harris | 126/350 R |
| 5,422,976 | 6/1995 | Knepler | 122/13.2 |

*Primary Examiner*—Denise L. Ferensic
*Assistant Examiner*—Gregory A. Wilson
*Attorney, Agent, or Firm*—Scully, Scott, Murphy & Presser

[57] ABSTRACT

A storage water heater including a vessel for accumulating a volume of water which is to be heated, said vessel having water inlet and outlet means, at least one gas burner, an exhaust gas outlet and a temperature regulating device. In order to evaluate the storage water heater behavior a calorimetric relationship is defined between the calories supplied by the burner and the volume of the vessel (Q/V) which ranges between 200 and 800 Kcal/H.l.

8 Claims, 2 Drawing Sheets

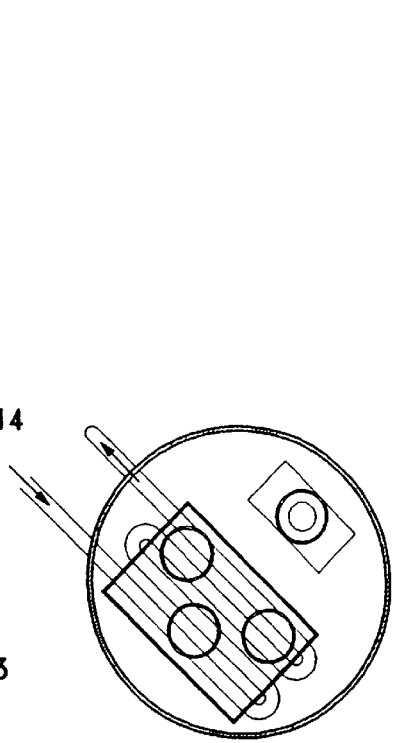
Fig.3
Fig.2
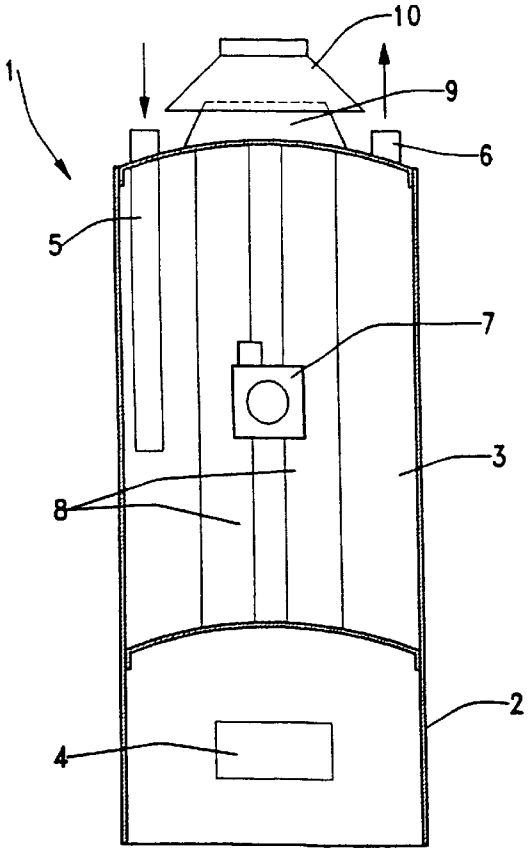
Fig.1

HEATING DEVICE

CROSS-REFERENCE TO RELATED APPLICATION

This application is a continuation-in-part application of Ser. No. 09/009,867; filed on Jan. 22, 1998.

BACKGROUND OF THE INVENTION

1. Field of the Invention

The present invention relates to improvements in water heating devices, and more particularly, pertains to a new and improved storage water heater, and is that a water heating device which is usually installed in a house or home for the providing of hot water for different uses in the kitchen, bathrooms, for washing machines, and the like.

2. Discussion of the Prior Art

There are several kinds of home water heaters which are currently known and utilized. One of these water heaters is the so-called "instantaneous water heater" which incorporates a heating coil carrying a flow of water which is to be heated, and at the bottom of which a set of gas burners provides a heat source for heating the flowing water. This type of heater allows for a constant flow of heated water; however, in the event that two or more taps are opened at the same time, there is a dramatic decrease in the water temperature. Consequently, such a water heater is useful only for circuits with a limited or small water flow; for example, for houses or houses possessing no more than a single bathroom. Furthermore, the use of this instantaneous water heater may be critical in water systems operating under a relatively water low pressure, since the appliance or heater itself may cause an undesirable drop in the water pressure.

Another kind of water heater, which is usually referred to as a "storage water heater", comprises a water vessel for accumulating a mass of water, under which vessel there is arranged a gas burner for heating the mass of accumulated water. This device allows for a flow of heated water over a limited period of time, and whereby several taps can be opened at the same time, while maintaining a constant temperature during a specified time, regardless of the water flow rate. This device is useful for lengthy water flow circuits, such as a home water circuit supplying several bathrooms, a kitchen, and so forth. In addition, this water heater does not cause any significant drop in the water pressure reigning in the piping system. However, this known type of storage water heater affords only a relatively low capacity for providing hot water because, on the one hand, the accumulated mass of heated water allows for a flow of water for only a limited period of time, (until the accumulated mass of heated water runs out), whereas, on the other hand, a considerable portion of the mass of heated water must be retained in the vessel, even when a user is not requiring any hot water. Once the mass of accumulated heated water runs out, replenishing the heated mass of water usually takes between about 45 and 80 minutes or even longer, depending upon the volume of water and the incoming replenishment water temperature. Moreover, these types of storage water heaters usually have a lower thermal efficiency than that achieved with instantaneous water heaters. Among various types of water heating devices and systems there may be considered U.S. Pat. No. 5,422,976 to Kuepler; U.S. Pat. No. 5,224,445 to Gilbert, Sr., U.S. Pat. No. 4,354,094 to Massey et al.; U.S. Pat. No. 1,502,295 to DeKermor, and Japanese Pat. Publ. 3-236502(A) to Tanaka. None of those publications; however, are directed to water heaters of the efficient type disclosed herein.

SUMMARY OF THE INVENTION

Accordingly, one of the objects of the present invention is to obviate the disadvantages encountered in prior art storage water heaters through the provision of improvements affording a better thermal efficiency and the capability of providing a permanent flow of heated water in the manner of an instantaneous water heater, but without the disadvantages and drawbacks thereof.

The storage water heater pursuant to the present invention allows for a permanent or continuous flow of heated water (without time limitations), and affords an excellent thermal efficiency improving the use of heat energy created by burners which are used for heating water accumulated in the vessel. The advantages of the present invention can be summarized, as follows:

(a) there is practically no drop in water pressure during operation;

(b) the water heater provides for the use of heated water at higher temperatures in comparison with an instantaneous water heater, whereby a user can mix this heated water with cold water in order to obtain a desired water temperature and a higher water flow rate of mixed hot and cold water;

(c) there is provided heated water at desired temperatures even in locations where running water is usually available at very low temperatures.

It is a further object of the present invention to provide a water heater possessing all of the advantages of storage and instantaneous water heaters while concurrently eliminating their drawbacks and limitations.

The present storage water heater includes, as usual, at least one gas burner located below a water vessel containing a mass of water which is to be heated, a combustion gas outlet connected to a chimney, and a water temperature regulating means with a gas safety device, but which is capable of providing a permanent or continuous flow of heated water.

As stated hereinabove, the present storage water heater is capable of supplying hot water for an unlimited period of time similar to that of an instantaneous water heater. Upon investigating the relationship existing between the heat energy created by the gas burners and the water volume which to be heated, the applicant has discovered the above stated behavior and defined a "Calorimetrical Relationship R", which is the ratio of the heat input Q to the volume of the water vessel V.

As has been investigated by the applicant, when Q is expressed in Kcal/hr (based on the gross calorific value of the gas used) and V is expressed in liters, the "Calorimetrical Relationship R=Q/V" should range between 200 and 800 Kcal/Hr × liter in order to obtain the desired behavior of this storage water heater, whereas contrastingly, prior art storage water heaters have R values ranging from 40 to 190 Kcal/hr × liter (as set forth in the Table below). By choosing this relationship between the heat input and the volume of the water vessel within the range between 200 and 800 Kcal/hr × liter, it is possible to construct an appliance with a predetermined volume V and the corresponding determined heat input Q supplied by the burner(s), which will provide heated water for several taps at the same time and for an indefinite period of time.

The foregoing is an unexpected and inventive result obtained from the investigation of the critical relationship existing between the heat which is supplied by burners and the volume of the water vessel, those values of which were obtained from the studying of the storage water heater.

It is a still further object of the present invention to provide a storage water heater with an improved and more efficient use of the heat delivered by gas burners, and more specifically, the heat from burner exhaust gas. In the technology, it is an old and widely known concern to be able to recover and utilize heat energy which is usually lost in the burner exhaust gas. Several ways have been developed for using this energy; for example, the use of heat energy derived from exhaust gas for automobile heating systems, for the heating of rooms, and so forth. In the present instance, the object resides in benefiting by the heat energy obtained from the burner exhaust gas. Through the proposed improvements, this heat energy is utilized more efficiently, thereby reducing the time which is required for heating to the desired temperature the mass of water accumulated in the vessel, each time the storage water heater is turned on, as well as for each time the mass of heated water is depleted and the heating process must in the current technology.

There are some storage water heaters in the current technology whose water vessel is penetrated by one or more central tubes for conveying the combustion gas and for transferring a part of the heat energy in this gas to the water in the vessel. However, the extent of this heat transfer is rather low. Therefore, there is a marked need for means which are capable of a more efficient use of the heat energy.

Thus, it is a further object of the present invention to provide a storage water heater with a better thermal efficiency, by improving the employment of combustion gas energy obtained from the exhaust gas.

BRIEF DESCRIPTION OF THE DRAWINGS

Reference may now be made to the accompanying drawings, in which:

FIG. 1 is a schematic longitudinal cross-section through a storage water heater incorporating the improvements pursuant the present invention;

FIG. 2 is a schematic longitudinal cross-section through an alternative embodiment of the storage water heater;

FIG. 3 is a transverse cross section of the embodiment of FIG. 2;

DETAILED DESCRIPTION OF THE PREFERRED EMBODIMENTS

Figure 4:
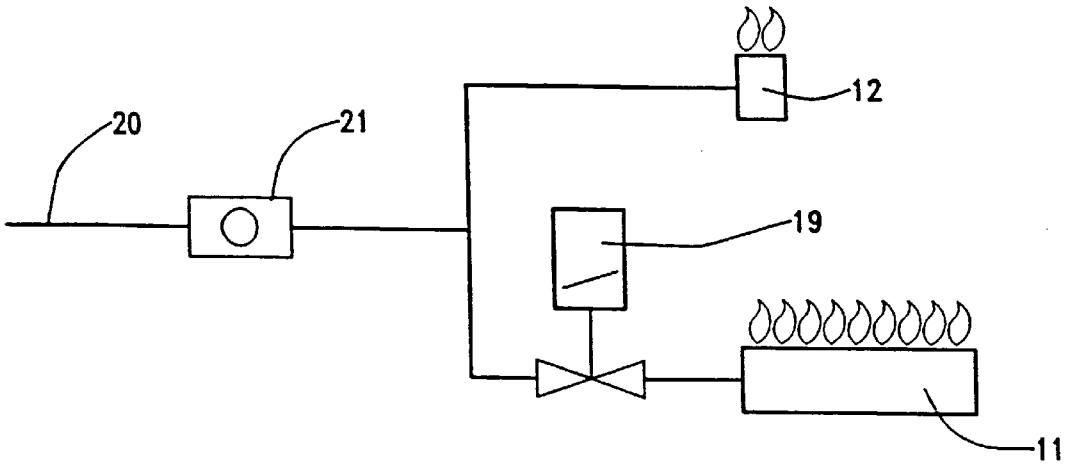
FIG. 4 schematically shows a gas circuit for the storage water heaters.

In the drawings, there is illustrated a storage water heater 1 which, as usual, includes a cylindrical casing 2 within which there is arranged a vessel 3 which is for water to be heated. Beneath the vessel 3, there is located at least one gas burner 4 for providing the necessary heat energy for heating the water which enters vessel 3 through a cold water inlet pipe tube 5, and exits through a hot water outlet pipe 6.

As known, a control 7, which incorporates a safety gas valve and a thermostat for temperature regulation, is adapted to cut off the gas flow to the burner(s) when the selected hot water temperature has been reached, and will initiate the gas flow again when the water temperature has dropped off some degrees below the cut off temperature.

A plurality of tubes 8 conduct the combustion gases upwardly. These gases enter a gas collector 9 and then pass through a draft diverter 10 having an outlet which is connected to a chimney (not shown).

Ordinarily, cold water enters the vessel 3 through a cold water inlet pipe 5. Heat generated by the burner 4 heats the water up to the temperature which has been previously preset by a user by means of the control 7, and the exhaust gases are conveyed to a chimney through tubes 8, the gas collector 9 and the draft diverter 10.

In the present embodiment, vessel 3 has a 50 liter capacity, and the burner 4 has a 21.000 kcal/hour power or energy output.

After extensive investigations, applicant surprisingly concluded that by stating a certain heat power supplied by burners in relation to the volume of the vessel, all of the known deficiencies (related to the lack of continuous flow of heated water) of the prior art storage water heaters have been obviated. In order to clearly understand the present invention a "calorimetric relationship R" is defined as the ratio of the heat input Q to the volume of the water vessel V, that is $R=Q/V$. The R average value ranges between 200 and 800 Kcal/hr × liter, and preferably between 400 and 500 Kcal/h l. That is, if 400 Kcal/h l is supplied, once hot water exits the vessel and fresh cold water enters the vessel, the heat input supplied should be adequate to maintain the water temperature at its present level. Thus, a user can uninterruptedly use hot water, such as with an instantaneous water heater, but at a constant temperature, regardless of the number of hot water taps which are opened at the same time.

FIGS. 2 and 3 illustrate an alternative embodiment of a storage water heater in which there is incorporated means for further improving the use of heat energy generated by the burners. This is attained by a novel heat exchanger. This embodiment comprises a main burner 11 and a secondary burner 12, a recirculating-water tube 13, a pump 14 for pumping water towards a heat exchanger 15 which is in fluid contact with a hot gas outlet 6 leading from the combustion chamber 16. It also includes a return hot water pipeline 17 to the vessel, and a bimetallic thermostat switch 18.

This storage water heater operates as follows: In the first embodiment of FIG. 1, the water heater operates as usual, with the difference residing in the above-referenced cited calorimetric relationship; that is, heat input supplied by the burners in relation to the volume of the vessel maintains the water temperature constant, even when a user is using hot water continuously.

Figure 5:
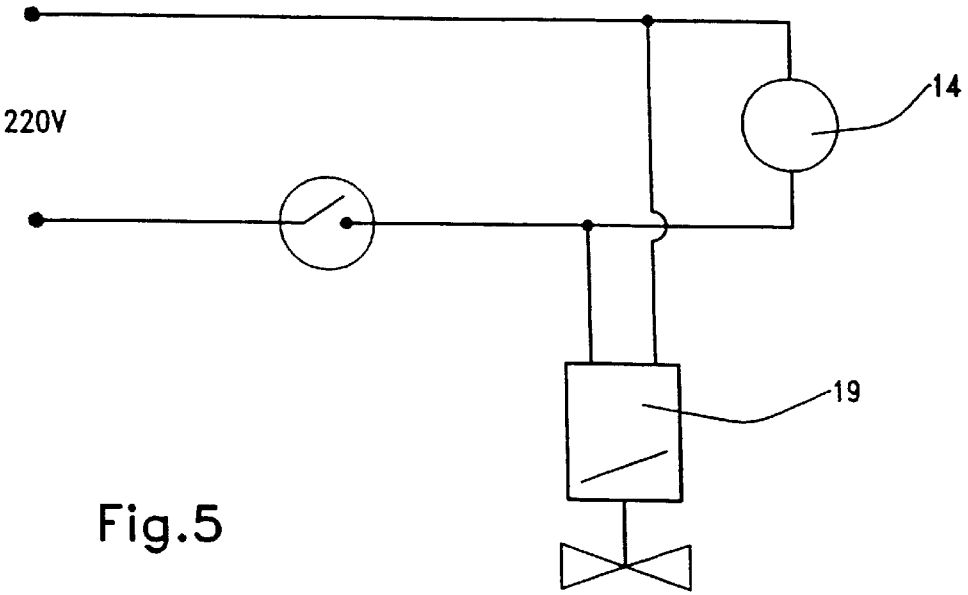
FIG. 5 schematically shows an electric circuit for the storage water heater.

In the embodiment of FIGS. 2 to 5, the storage water heater operates as follows:

When the water temperature drops off to below the temperature value which has been preset by a user by means of thermostat 7, the gas flow to burners 11 and 12 is initiated by the thermostat, but only the secondary burner 12 is ignited because the electrovalve 19 remains closed thereby preventing the gas flow to the main burner 11.

Once the burner 12 is ignited, the combustion gases flow through the tube above it, flowing towards the upper outlet sensor 18 which is arranged at the top, and which is activated by the hot gases, and the electrical circuit supplying the pump 14 and the electrovalve 19 is closed. Thus, the pump pumping water from the bottom part of the vessel causes it to circulate through the heat exchanger 15. Water flows from the exchanger outlet to circulate through pipe 17 again into the vessel. At the same time, electrovalve 19 opens and the main burner 11 is ignited. The hot combustion gases which are thus generated, flow through the tubes arranged above, and when the gases reach the upper part, they pass through the heat exchanger 15 which is arranged at the outlet of the tubes.

The additional heat transfer produced in the heat exchanger, plus the acceleration of water convection inside the vessel caused by recirculation due to the pump, increases the heat transfer between the hot gases and the water, thereby improving the thermal efficiency.

Once the flowing water reaches the desired preset temperature, the gas flow towards the main and secondary burners is terminated by thermostat 7. Shortly thereafter, the sensor 18 cools down so that the electric circuit is opened, the pump is deactivated and the cycle is finished.

Finally, a comparison among some different types of water heaters available on the market illustrates the following results:

| Thermotank Brand | Capacity (liters) | Power Kcal/h | Calorimetric Relationship Kcal/liters |
|---|---|---|---|
| Rheem | 250 | 30.000 | 120 |
| Rheem | 300 | 50.000 | 167 |
| Rheem | 190 | 12500 | 66 |
| Rheem | 120 | 8000 | 67 |
| Rheem | 150 | 8000 | 53 |
| Rheem | 85 | 6000 | 70.5 |
| Rheem | 60 | 4000 | 67 |
| Ecotermo | 23 | 4300 | 187 |
| Ecotermo | 50 | 5000 | 100 |
| Emege | 150 | 7500 | 50 |
| Emege | 120 | 7400 | 61.6 |
| Emege | 85 | 6100 | 71.7 |
| Señorial | 150 | 6000 | 40 |
| Señorial | 110 | 5000 | 45.4 |
| Señorial | 75 | 5000 | 66.6 |
| Señorial | 30 | 5000 | 166.6 |
| Los Andes | 600 | 60.000 | 100 |
| Los Andes | 500 | 48.000 | 96 |
| Los Andes | 400 | 42.000 | 105 |
| Los Andes | 300 | 35.000 | 116.6 |
| Los Andes | 250 | 28.000 | 112 |

From the above table it can be clearly ascertained that prior art storage water heaters define a calorimetric relationship R=Q/V which always ranges below 187 Kcal/Hour.liter. The proposed storage water heater provides an important innovation by defining said range between 200 and 800 Kcal/H.l. Thus, a storage water heater with a capacity of about 110 liters and a power or energy output of 22.000 Kcalories/hr defines an R value of about 200 Kcal/H.l., allowing a behavior similar to that of an instantaneous water heater with a continuous flow of heated water available at the same time at several locations of the same water circuit.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. In a storage water heater, comprising a vessel for accumulating a volume of water which is to be heated, said vessel including water inlet and outlet means, at least one gas burner for heating said water in said vessel, exhaust gas outlet means, and temperature regulating means, the improvement wherein the calorimetric relationship "R" between the heat supplied by said burner and the volume of the vessel (R=Q/V) ranges between 200 and 800 Kcal/H. l.

2. A storage water heater in accordance with claim 1, wherein said vessel has a 50 liter capacity and the burner supplies power of about 21,000 Kcal./hour.

3. A storage water heater in accordance with claim 1, comprising a heat exchanger in fluid contact with the burner exhaust gas, and tubes connecting said heat exchanger with said vessel containing the water which is to be heated.

4. A storage water heater in accordance with claim 3, wherein a water pump is arranged in a water recirculation tube extending between said vessel and said heat exchanger.

5. A storage water tank in accordance with claim 3, wherein two said burners comprise, respectively, a main burner and a secondary burner.

6. A storage water tank in accordance with claim 5, wherein a sensor is arranged at the exhaust gas outlet and an electrovalve is arranged at a main burner gas circuit.

7. A storage water tank in accordance with claim 5, wherein said vessel has a 50 liter capacity and said main burner supplies about 40,000 Kcal./H.

8. A storage water tank in accordance with claim 5, wherein said vessel has a 110 liter capacity and said main burner supplies about 22,000 Kcal./H.

* * * * *